United States Patent [19]

Romer et al.

[11] 4,119,037

[45] Oct. 10, 1978

[54] CARRIER PROJECTILES FOR EJECTABLE PAYLOADS

[75] Inventors: Rudolf Romer, Kaarst; Rolf Hellwig; Dietmar Karius, both of Duesseldorf, all of Fed. Rep. of Germany

[73] Assignee: Rheinmetall GmbH, Duesseldorf, Fed. Rep. of Germany

[21] Appl. No.: 746,837

[22] Filed: Dec. 2, 1976

[30] Foreign Application Priority Data

Dec. 22, 1975 [DE] Fed. Rep. of Germany ..... 2558060

[51] Int. Cl.[2] ..... F42B 13/50

[52] U.S. Cl. ..... 102/69; 102/37.6

[58] Field of Search ..... 102/6, 7.2, 34.4, 35.6, 102/37.6, 66–69, 89 C, 89 D, 90

[56] References Cited

U.S. PATENT DOCUMENTS 3,956,990 5/1976 Rowe ..... 102/69

FOREIGN PATENT DOCUMENTS 2,352,576 10/1972 Fed. Rep. of Germany ..... 102/69

*Primary Examiner*—Verlin R. Pendegrass

[57] ABSTRACT

A versatile carrier projectile for receiving and ejecting differently-sized ejectable payloads such as guided missiles and incendiary bombs is described. The payloads are disposed in successive, longitudinally spaced relation within a central cylindrical body of the projectile, with successive ones of the payloads being separated by a spacer disc. Each spacer disc carries an outwardly biased blocking rod. The outer end of each blocking rod terminates in engagement with a sawtooth-shaped groove on the inner periphery of the cylindrical body, so that the forward propulsion of the successive payloads through the cylindrical body is accomplished under a steady spring load of the blocking member on the inner wall of the cylindrical body. The front and rear portions of the cylindrical body are respectively secured to the shell head and the ignition charge container by shear pins. Other shear pins are provided to secure a drive disc to the rear portion of the ignition charge container, and a flange extending forwardly from the outer surface of the drive disc serves to normally confine the pivoted rear ends of a plurality of stabilizing wings in their retracted position until the projectile exits from the barrel of the firing weapon.

9 Claims, 3 Drawing Figures

51
4
3
6
61
15
19
16
18
17
54
52
1
53
1a
10
10a
14
62
5
7a
12
13
2
7
9
82
81
71
11

CARRIER PROJECTILES FOR EJECTABLE PAYLOADS

BACKGROUND OF THE INVENTION

The invention relates to a carrier projectile for supporting and successively ejecting a plurality of payloads normally disposed in a central cylindrical portion of the projectile.

In known carrier projectiles of this type, the ejectable payloads (e.g., incendiary bombs, guided missles, mines, or the like) are maintained out of contact with each other by means of spacer plates. After a predetermined flight time of the projectile, an ignition charge, disposed in a container situated rearwardly of the payload-containing cylindrical body is ignited, thereby forcing an associated plunger forwardly to correspondingly propel the successive spaced payloads through the cylindrical body, after which they are suitably liberated from the projectile.

A disadvantage of such known carrier arrangements is that the use of even slightly differing sizes of payloads results in changes in the propulsion load, thereby necessitating the use of different ignition charge capacities and/or configurations. In addition, the use of different-sized payloads within a given projectile has required the use of special retainers to immobilize the projectiles prior to their desired ignition time.

The resultant necessity of virtually custom-altering the carrier projectiles to accommodate different sizes of payloads has proved to be inefficient and expensive.

SUMMARY OF THE INVENTION

Such disadvantages are overcome with the improved carrier projectile of the present invention, which is adapted to accommodate different sizes of payloads without changing the projectile configuration and/or payload retainers.

In an illustrative embodiment, a central cylindrical portion of the projectile has a plurality of axially spaced, sawtooth-shaped annular grooves which are aligned with the support plates, such grooves tapering inwardly in a forward direction. A plurality of pawl-like blocking rods are carried by the support plates and are resiliently biased outwardly into the associated grooves whereby successive ones of such blocking rods serve to immobilize the payload captured between the associated support plates prior to ignition.

Upon ignition, the simultaneous forward propulsion of the payloads within the cylindrical body of the projectile causes each blocking rod to move forwardly and thereby converge inwardly in its groove, and each rod thereby continues along the inner wall of the cylindrical body to provide a constant propulsion load, thereby permitting the use of a common ignition charge package for each payload size.

The ignition charge container and the fuse-carrying shell head of the projectile are respectively removably secured to the rear and front portions of the central cylindrical body. During ignition, the forwardly propelled payloads effect a shearing of the associated pin to release the shell head, so that the payloads can be released through the now-open front end of the projectile.

A plurality of conventional wing stabilizers are pivotally connected, at their respective rear ends, to the rear portion of the central cylindrical portion of the projectile. In order to maintain the stabilizers in their retracted position against the force of an outward biasing spring while the stabilizers remain within the barrel of the firing weapon, a conventional drive disc disposed in abutting relation to the rear end of the ignition charge container has a forwardly extending flange that axially overlaps the rear end of the unoperated stabilizers.

The drive disc, which is separable from the container charge housing when the carrier projectile is fired out of the barrel of the weapon, is initially removably secured to the charge container by means of an additional shear pin that extends into the charge container through an intermediate portion of the drive disc flange.

BRIEF DESCRIPTION OF THE DRAWING

The invention is further set forth in the following detailed description taken in conjunction with the appended drawing, in which.

DETAILED DESCRIPTION

Figures 1, 2, 3:
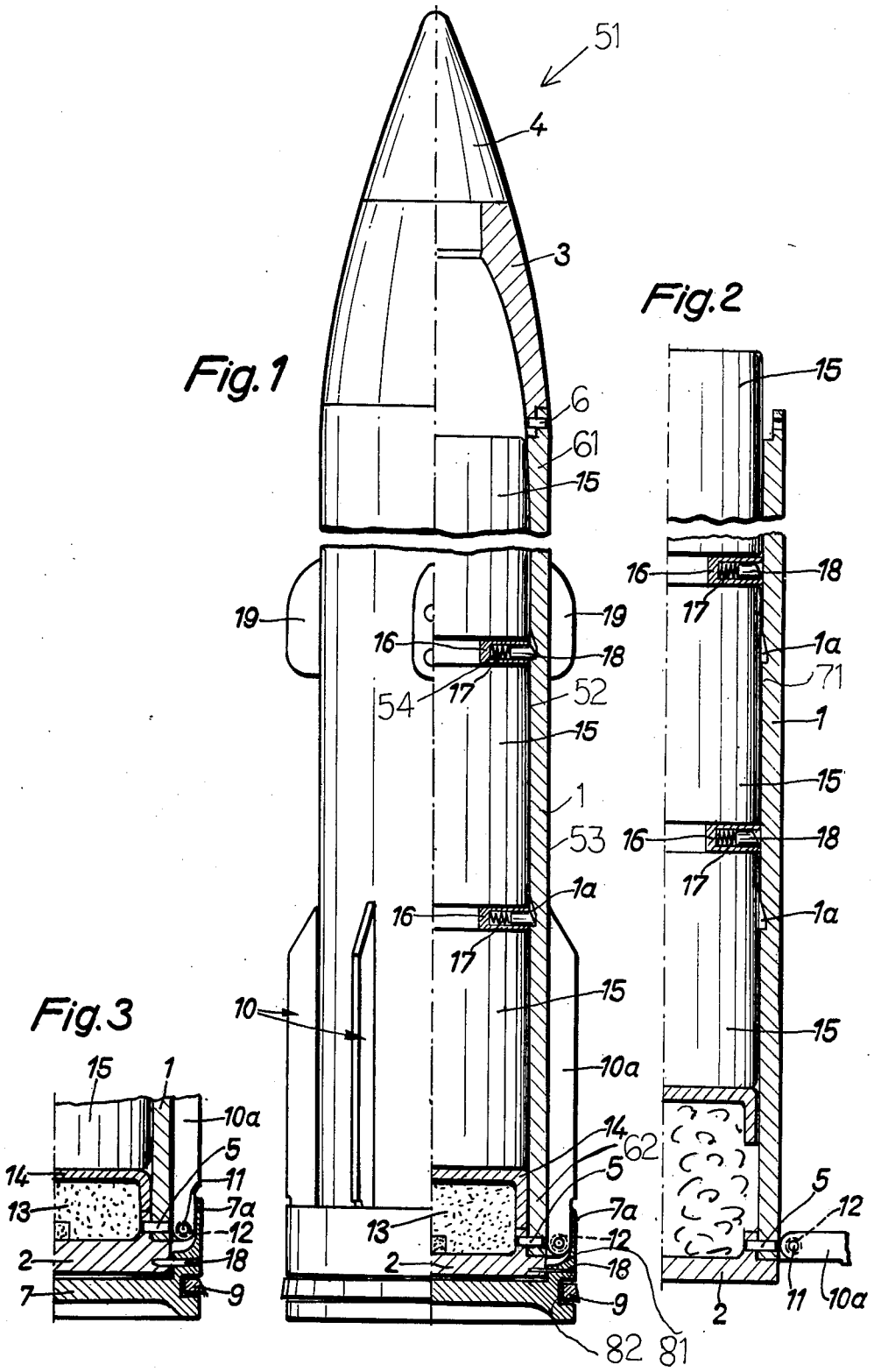
FIG. 1 is a longitudinal view, partially in section, of a multi-payload carrier projectile constructed in accordance with the invention.
FIG. 2 is an enlarged fragmentary view, in section, of the rear portion of the projectile of FIG. 1.
FIG. 3 is a longitudinal view of a portion of the projectile of FIG. 1 immediately following the ignition of the ejecting charge for the successive payloads.

Referring now to the drawing, a carrier projectile 51 constructed in accordance with the invention includes a central cylindrical body 1 having smooth inner and outer surfaces 52 and 53, respectively. A plurality of ejectable payloads 15, which may be incendiary bombs, missles, mines, or the like, are disposed in spaced longitudinal succession within the central body 1 for ejection in seriatim fashion during the flight of the projectile 51, and in particular after a predetermined time of flight determined by the delay characteristics of a nose-mounted fuse 4.

The successive ones of the payloads 15 are longitudinally separated by means of a succession of separation plates 16, which in the embodiment shown may be in the form of an annular plate. Each plate 16 has a radial bore 54 extending inwardly from an outer surface thereof for the purposes indicated below.

A shell head 3, whose front end is associated with the nose fuse 4, is removably secured to a front portion 61 of the central projectile body 1 by means of a plurality of circumferentially spaced shear pins 6, only one of which is illustrated. In like manner, a charge container housing 2, which supports an ignition charge 13 therein, is removably secured to a rear portion 62 of the central body 1 by means of a plurality of circumferentially spaced pins 5, only one of which is shown. In a conventional manner, the detonation of the charge 13, initiated by the time-delay fuse 4, will be effective to cause a separation, from the housing 2, of a front plunger section 14 thereof as shown in FIG. 2, whereby the payloads 15 supported within the central body 1 will be propelled forwardly by the moving plunger, causing the shearing off of the pin 6 and thereby freeing the successive payloads 15 from the projectile 51 after the now-loosened shell head 3 is separated from the projectile.

It will be appreciated that under ordinary circumstances, a change in size of the payloads 15 will cause a variable load on the plunger 14 after detonation of the charge 13, due to the variable friction of the payloads on the adjacent wall of the central portion 1 and by similar factors. To eliminate this disadvantage, the central portion 1 exhibits, at longitudinally spaced positions along its inner wall 52, a plurality of annular grooves 1a whose principal portions taper inwardly as shown to merge with the main diameter of the inner wall 52. The respective grooves 1a are disposed in radial alignment with the bores 54 of the support plates 16 when the payloads 15 are in their initial rest positions prior to ejection. Preferably, as indicated in FIG. 2, each groove 1a terminates rearwardly in a radial wall 71, thereby imparting a sawtooth shape to the groove.

A pawl-like blocking rod 18 projects outwardly beyond the outer surface of each of the radial bores 54 in the plates 16, each such rod 18 being urged in a radial outward direction by means of a spring 17 situated in the bottom of the respective bore. The outer end of each rod 18 is firmly urged into engagement with the rear portion of the annular sawtooth groove **1*a* on the central projectile portion 1, thereby assuring a firm immobilization of the payloads 15 in their rest position. Preferably, the outer end of each blocking rod 18 is in engagement with the radial back surface 17 of the associated groove, so that inadvertent rearward movement of the plates 16, and thereby the payloads 15**, is avoided.

With such arrangement, a forward movement of the plunger 14 associated with the shell bottom 2 after the charge 13 is detonated will cause the rods 18 to be cammed inwardly by the tapers of the associated grooves **1*a*, after which such rods 18 will bear against the inner surface 52 of the central portion 1 with a spring force determined by the constants of the springs 17 while the payloads 15 move through the central portion 1. Such spring force represents a constant load on the moving plunger 14, irrespective of the size of the interposed payloads 15; therefore, the same type and size of charge 13** may be employed irrespective of variations in the payload size.

A wing stabilization section 10 is associated with the rear portion 62 of the projectile 51. The portion 10 includes a plurality of elongated stabilizers 10a, which are disposed in circumferentially spaced relation around the body 1. Each stabilizer **10*a* is pivotally supported at its rear end by means of a hinge 11 carried by the rear portion 62 of the body 1. The stabilizers 10*a* are simultaneously movable between an unoperated position shown in FIG. 1, in which each stabilizer 10a extends forwardly in parallel and abutting relation to the outer surface 53 of the body 1, and an operated position shown in FIG. 2, in which each stabilizer 10*a* extends substantially radially outwardly from the rear portion 62 of the body 1. A spring 12 is secured to each hinge 11 for normally outwardly biasing the adjacent stabilizer 10*a*** toward its operated position.

A conventional drive disc 7 is disposed behind the charge-carrying shell bottom 2, and is designed to absorb the force of propulsion of a propellant charge (not shown) of the associated firing weapon when the projectile 51 is to be fired out of the barrel of such weapon. In order to secure the drive disc 7 to the shell bottom 2 prior to such firing, the drive disc 7 includes a flange portion 81 extending forwardly from an outer surface of the disc. A plurality of shear pins 18 extend radially inward through an intermediate portion of the flange 81 and terminate within the shell bottom 2.

The outer surface of the drive disc 7 has a radial recess 82 disposed therein. A guide ring 9 is rotatably supported in the groove 82 for maintaining contact with the barrel of the firing weapon as the projectile 51 advances therethrough, in order to prevent the generation of excessive twist to the projectile as it leaves the weapon.

The flange 81 of the drive disc 7 has a front portion 7a which axially overlaps the rear portion of each of the stabilizers **10*a*, thereby restraining such stabilizers 10*a* in their unoperated position abutting the projectile body 1 against the force of the spring 12**.

The depicted arrangement operates as follows. During the time that the projectile 51 is at rest within the barrel of the firing weapon, such projectile is maintained centralized in such barrel by means of a plurality of guide cams 19 extending outwardly from the front portion 61 of the central body 1. The stabilizer arrangement 10 is in the position shown in FIG. 1, with the individual stabilizers **10*a* restrained by the flange 81 against the outer surface 53 of the body 1**.

When the propellant charge (not shown) associated with the firing weapon is detonated, the resulting propulsion force initially breaks the shear pins 18, so that the drive disc 7 is no longer secured to the shell bottom 2. Consequently, as soon as the projectile 51 exits from the barrel, the drive disc 7 separates from the shell body 2, thereby removing the restraining influence of its associated flange 81 from the stabilizers **10*a*. Accordingly, each of the stabilizers 10*a* move outwardly into their stabilizing position shown in FIG. 2**.

After an interval determined by the time delay characteristic of the fuse 4, the ignition charge 13 in the shell bottom 2 is suitably ignited, whereupon the plunger portion 14 of such shell bottom 2 is shot forwardly to move the successive projectiles 15 forwardly. During such forward movement, the force of the front-most payload 15 on the shell head 3 will shear off the pins 6, so that the shell head 3 will be ejected to open the front end of the projectile 51. The payloads 15 will accordingly be ejected seriatim in a forward direction. During the forward movement of the payloads 15 within the body 1, the outer ends of the blocking rods 18 will be maintained in constant contact with the inner wall 52 of the body 1 by means of the springs 17, thereby assuring a constant load on the forwardly-moving plunger 14.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In a carrier projectile adapted for supporting and ejecting a succession of longitudinally spaced payloads when an ignition charge disposed in the projectile is ignited, a central cylindrical body for receiving the successive payloads, a shell head coupled to a forward portion of the body, an ignition charge container coupled to a rear portion of the body, plunger means associated with the front portion of the ignition charge container for propelling the payloads forwardly when the charge in the charge container is ignited, a plurality of spacer elements disposed in longitudinally spaced relation in the cylindrical body for separating confronting ends of adjacent ones of the payloads, the portions of the inner wall of the cylindrical body radially aligned with the spacer elements having respective annular grooves tapering inwardly in a forward direction, and a blocking element carried by each spacer element and resiliently urged radially outwardly into contact with the associated groove on the cylindrical body so that each payload is propelled forwardly by the plunger under a positive load established by the urging force of the blocking means on the inner surface of the cylindrical body after ignition is effected.

2. A projectile as defined in claim 1, further comprising at least one radially extending shear pin for removably securing the shell head to the front portion of the cylindrical body.

3. A projectile as defined in claim 1, further comprising at least one radially extending pin for securing the ignition charge container to the rear portion of the cylindrical body.

4. A projectile as defined in claim 1, further comprising a drive disc situable behind and cooperable with the ignition charge container, the drive disc having a flange forwardly extending from the outer surface thereof, and at least one shear pin radially extending through the flange intermediate its ends and into the rear portion of the ignition charge container to removably secure the drive disc to the ignition charge container.

5. A projectile as defined in claim 4, further comprising a plurality of pivotal mounting means arranged in circumferentially spaced relation on the outer surface of the rear portion of the cylindrical body, a plurality of elongated stabilizers individually connected at respective rear ends thereof to the respective pivotal mounting means for movement between an unoperated position in which each stabilizer extends longitudinally forwardly along the cylindrical body in abutting relation therewith and an operated position in which such stabilizer extends radially outwardly from the rear portion of the cylindrical body, and spring means associated with each pivotal mounting means for normally urging the associated stabilizer outwardly into its operated position.

6. A projectile as defined in claim 5, in which the front portion of the flange on the drive disc is positioned, while the disc is secured to the ignition charge container, to axially overlap the outer surface of the rear portion of each stabilizer when such stabilizer is in its unoperated position to normally confine the stabilizer in the unoperated position against the force of the spring means.

7. A projectile as defined in claim 4, in which the drive disc has an annular recess disposed in its outer surface, and in which the projectile further comprises an annular guide ring rotatably mounted in the annular recess.

8. A projectile as defined in claim 1, in which each spacer element comprises an annular ring having at least one radial bore extending inwardly from an outer surface thereof; in which the projectile further comprises a compression spring disposed in each bore; and in which the blocking members comprise elongated rods extending into the respective bores and having inner ends cooperable with the outer ends of the springs disposed therein.

9. A projectile as defined in claim 1, in which each annular groove on the cylindrical body has a radially extending rear wall which cooperates in sawtooth fashion with the inward taper.

* * * * *